United States Patent [19]

Peters

[11] Patent Number: 4,759,004

[45] Date of Patent: Jul. 19, 1988

[54] MECHANISM FOR AUTOMATIC WINDING OF A CLOCK

[76] Inventor: George Peters, 313 Lydia La., Cheektowaga, N.Y. 14225

[21] Appl. No.: 142,568

[22] Filed: Jan. 11, 1988

[51] Int. Cl.[4] ..... G04C 21/00

[52] U.S. Cl. ..... 368/150

[58] Field of Search ..... 368/124, 136, 139, 147–152

[56] References Cited

U.S. PATENT DOCUMENTS

| | | | |
|---|---|---|---|
| 391,969 | 10/1888 | Himmer | 368/150 |
| 814,767 | 3/1906 | Clark | 368/136 |
| 1,037,643 | 9/1912 | Kuhn | 368/152 |
| 1,104,345 | 7/1914 | Castel | 368/150 |
| 1,194,928 | 8/1916 | Auer | 368/150 |
| 1,202,424 | 10/1916 | Putnam | 368/152 |
| 1,211,383 | 1/1917 | Bangerter | 368/152 |
| 1,705,025 | 3/1929 | Meyer | 368/150 |
| 1,952,030 | 3/1934 | Korfhage | 368/150 |
| 4,165,606 | 8/1979 | Müller | 368/207 |

*Primary Examiner*—Vit W. Miska

*Attorney, Agent, or Firm*—Bean, Kauffman & Bean

[57] ABSTRACT

A mechanism for automatically winding a weight driven clock includes a common traveler member mounted for reciprocating movement between a rest and reversal position, a pulling member associated one with each weight of the clock and adapted to exert a pulling force on its supporting chain, a latch mechanism for each pulling member for selectively coupling same for movement with said traveler member, a weight sensing mechanism for sensing the arrival of each weight of the clock in a clock unwound position thereof for operating the latch mechanism of the pulling member associated with such weight and for initiating movement of the traveler member from its rest position, whereby a pulling force is exerted by the pulling member on the chain of its associated weight when placed in the unwound position thereof for lifting such weight into a clock wound position thereof coincident to the arrival of the traveler member in its reversal position, and a device for sensing the arrival of the traveler member in its reversal position for initiating return thereof and the pulling member to rest position.

9 Claims, 3 Drawing Sheets

Fig. 1.
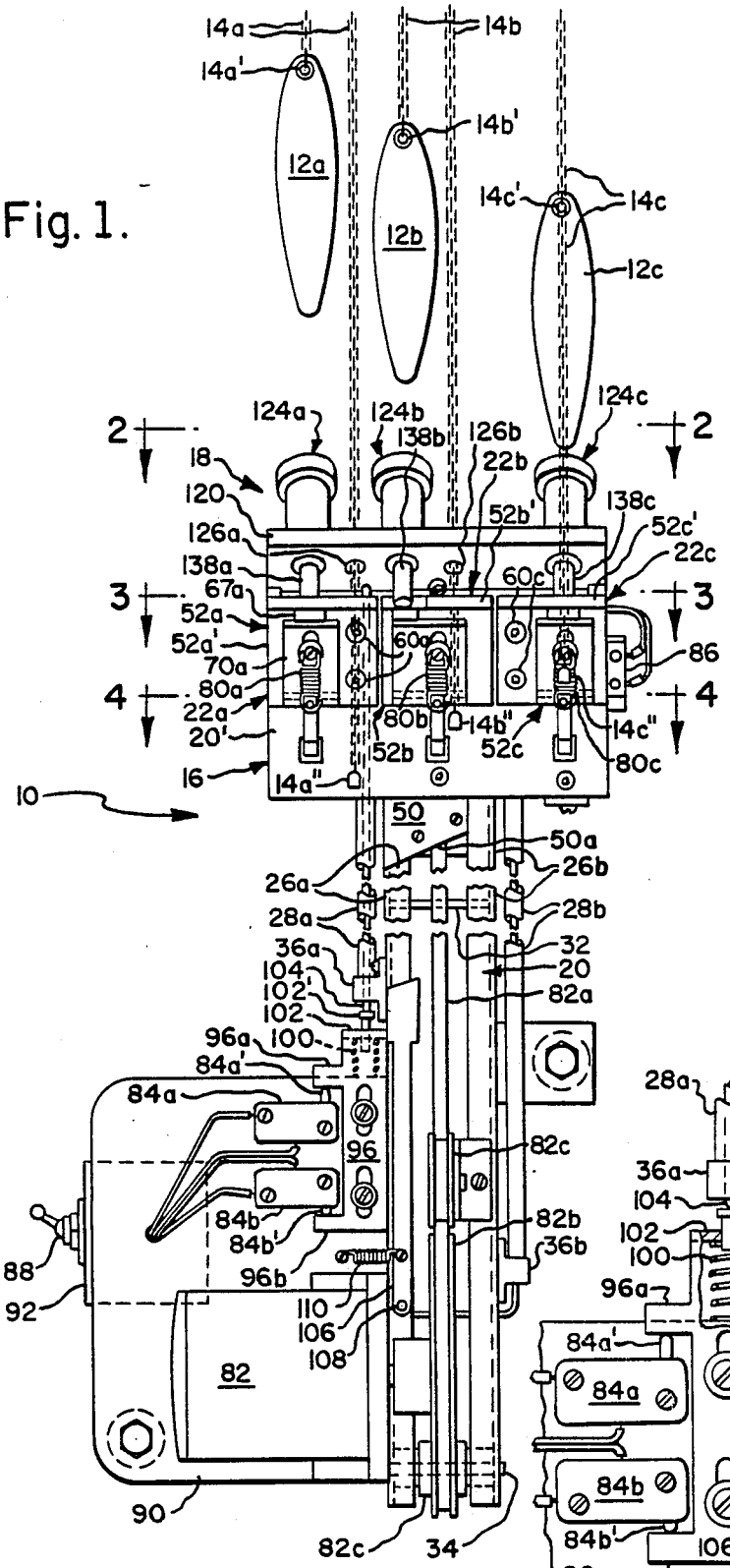
Fig. 9.
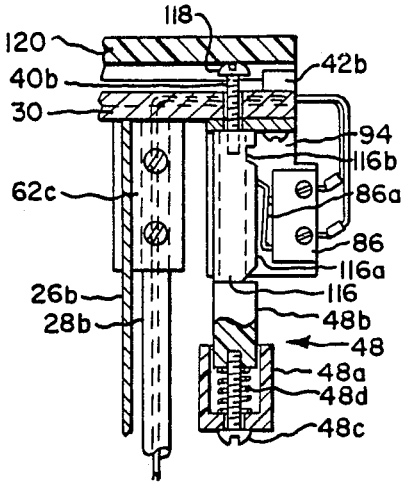
Fig. 10.
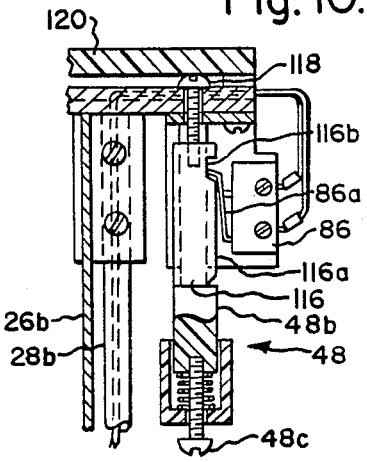
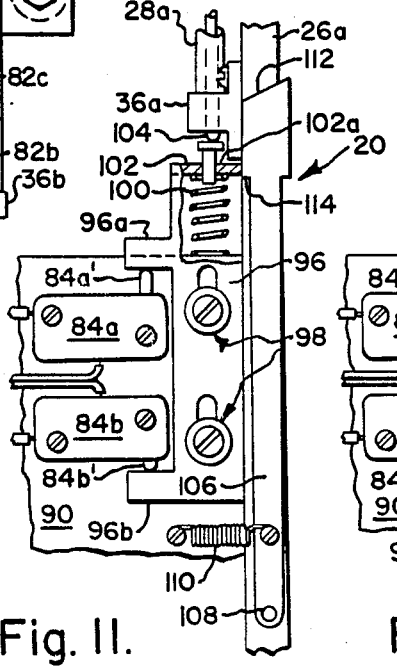
Fig. 11.
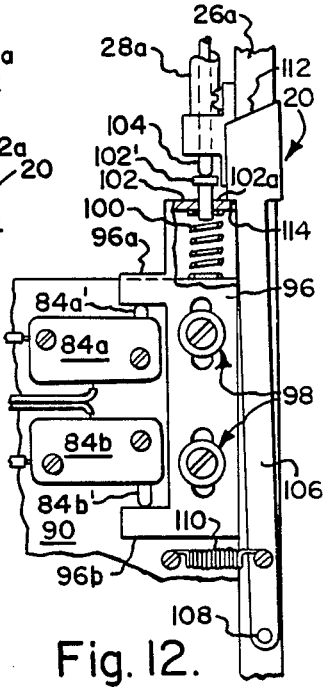
Fig. 12.

MECHANISM FOR AUTOMATIC WINDING OF A CLOCK

BACKGROUND OF THE INVENTION

Heretofore, various types of mechanisms have been proposed for use in effecting the automatic winding of weight driven clocks, as evidenced by U.S. Pat. Nos. 391,969; 1,037,643; 1,194,928; 1,705,025 and 4,165,606.

A drawback of the prior mechanisms of which I am aware is that same are incorporated as an integral part of clock structure or its drive mechanism, and thus such winding mechanisms are not readily adapted for use in the rewinding of existing clocks without requiring modification thereof.

SUMMARY OF THE INVENTION

The present invention relates to a mechanism for automatically winding weight driven clocks, and more particularly to a mechanism of this type, which can be employed to wind an existing weight driven clock without requiring modification of the clock or its drive mechanism.

The present winding mechanism generally includes a pulling means, which is engageable with a free end of a weight supporting chain and movable along a vertical path of travel for pulling down on the chain in order to raise the weight between unwound and wound positions; a weight sensing means responsive to lowering of the weight into its unwound position to effect operation of the pulling means; and sensing means for returning the pulling means to its original position after placement of the weight in its wound position.

The present mechanism is particularly adapted for use in winding of clocks having two or more weights, which may arrive out of phase at their respective unwound positions.

BRIEF DESCRIPTION OF THE DRAWINGS

The nature and mode of operation of the present invention will now be more fully described in the following detailed description taken with the accompanying drawings wherein:

FIG. 1 is a partial front elevational view of a clock winding mechanism of the present invention shown in association with the weights and chains of a multiple weight driven clock;

FIG. 9 is a sectional view taken generally along the line 9—9 in FIG. 4;

FIG. 10 is a sectional view similar to FIG. 9, but showing a subsequent step in the operation of the mechanism;

FIG. 11 is an enlarged, fragmentary view of the lower end of the mechanism; and FIG. 12 is a view similar to FIG. 11, but showing a subsequent step in the operation of the mechanism.

DETAILED DESCRIPTION

Figure 2:
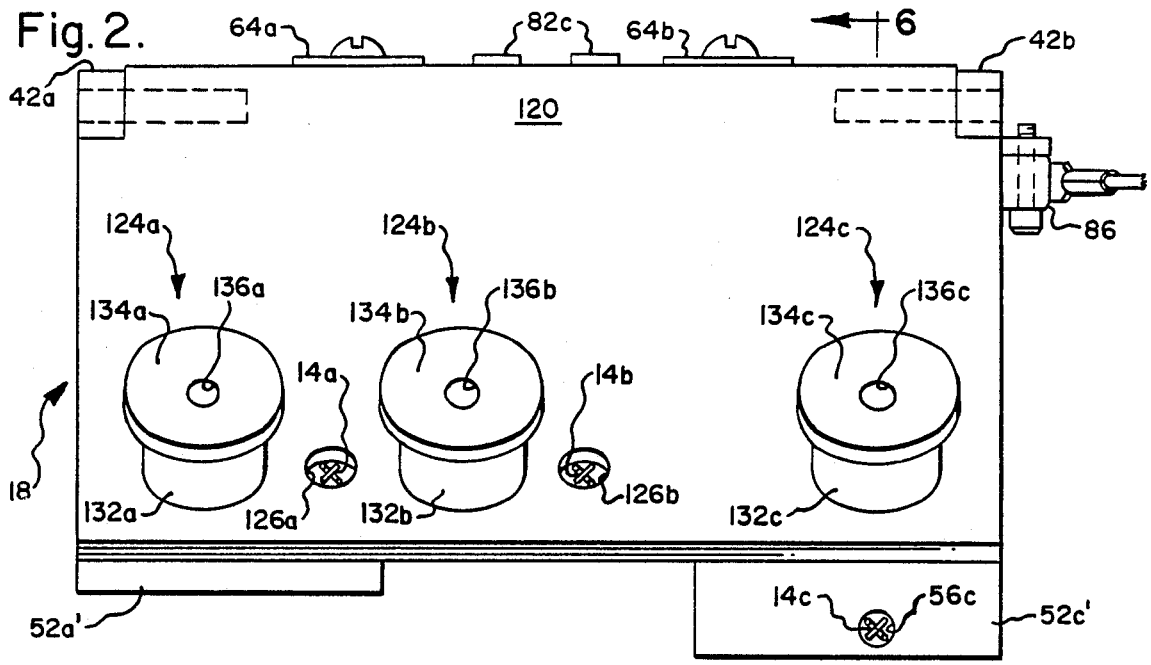
FIG. 2 is a top plan view of the mechanism.
Figure 3:
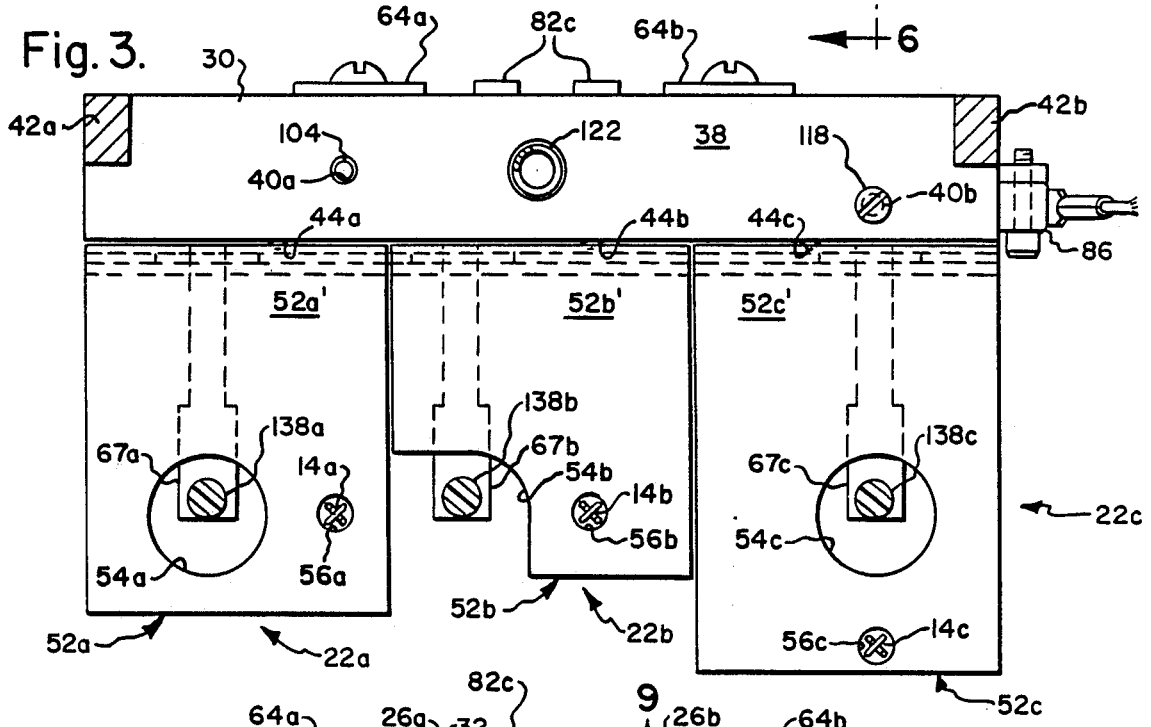
FIG. 3 is a sectional view taken generally along the line 3—3 in FIG. 1.

Reference is first made to FIG. 1, wherein a mechanism formed in accordance with the present invention is generally designated as 10 and shown in association with a plurality of weights 12*a*, 12*b* and 12*c* supported for vertical movement relative to a conventional weight driven clock mechanism, not shown, by flexible chains 14*a*, 14*b* and 14*c*. These chains have first ends 14*a*′, 14*b*′ and 14*c*′, which are suitably attached to weights 12*a*, 12*b* and 12*c*, respectively, and second or free ends 14*a*″, 14*b*″ and 14*c*″, which move in a direction opposite to the directions of movement of their associated weights in that intermediate portions of the chains, not shown, are trained over clock mechanism drive sprockets, also not shown. In many clocks, the chain free ends 14*a*″, 14*b*″ and 14*c*″ are enlarged, as by adding thimbles shown in the drawings, which engage with a suitable stop device to prevent such free ends from "running through" the clocks and allowing the weights to become uncoupled therefrom and fall to the floor. Where such thimbles are not originally provided with a clock intended to be wound by mechanism 10, it would be necessary to add such thimbles in order to permit coupling of the mechanism to such clock.

In a typical three weight drive arrangement of the type shown in FIG. 1, weights 12*a*, 12*b* and 12*c* and chains 14*a* and 14*b* are arranged such that they are essentially vertically bisected by a common vertical plane, and chain 14*c* is displaced through 90 degrees from chains 14*a* and 14*b* such that weight 12*c* and chain 14*c* are bisected by a vertical plane disposed essentially normal to the common vertical plane.

It will also be understood that weights 12*a*, 12*b* and 12*c* may be considered as each having an upper or clock wound position, not shown, which may be defined for example by a stop arranged for engagement by the weights and a lower or clock unwound position defined by engagement of chain free ends with a chain "run through" preventing stop mentioned above. In accordance with the present invention, an intermediate unwound position for the clock weights is defined by mechanism 10 and shown for instance in the case of weight 12*c* in FIG. 7, which is disposed essentially midway between the wound and potential unwound positions of such weights. In clocks not provided with an automatic winding mechanism, it is necessary for a person charged with the maintenance of a clock to periodically lift its weights for return to their wound positions by manually pulling down on the chains adjacent their free ends 14*a*″, 14*b*″ and 14*c*″. In that weights 12*a*, 12*b* and 12*c* typically drive different portions of a clock mechanism, e.g. the timing mechanism, the sound producing or striking mechanism and the visual display mechanism, such as in a cuckoo clock, the weights seldom occupy the same vertical position and/or arrive at their respective unwound positions at the same instant.

While a preferred form of mechanism 10 particularly adapted for use with a three weight clock mechanism will be described, it will be understood that such mechanism may be readily adapted for use in the automatic winding of clocks having any desired number of weights and is operable regardless of the number of such weights which might arrive at their unwound positions at any one time.

Figure 5:
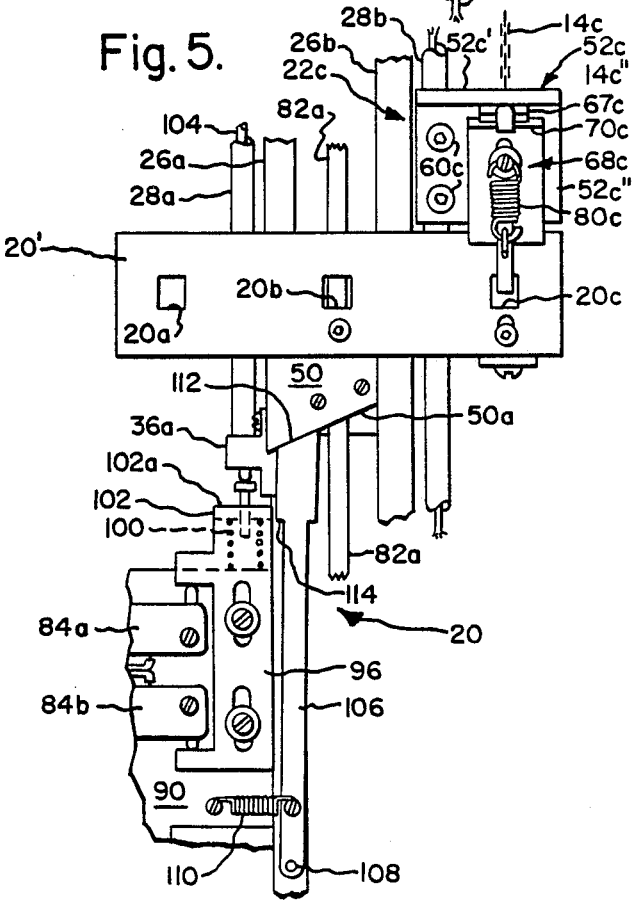
FIG. 5 is a fragmentary front elevational view illustrating the traveler member and one of the pulling members in a lower reversal position thereof.

In its broadest aspect, mechanism 10 includes a chain pulling means 16, which is movable along a vertical path of travel between an upper rest and a lower reversal position shown in FIGS. 1 and 5, respectively, for purposes of exerting a downwardly directed pulling force on one or more of chain ends 14*a*", 14*b*" and 14*c*" for purposes of raising their associated weights into their wound positions; a weight sensing means 18, which is responsive to the arrival of any one or more of weights 12*a*, 12*b*, 12*c* in their unwound positions for initiating movement of the chain pulley means from its rest position towards its reversal position; and sensing means 20 responsive to the arrival of the chain pulling means in its reversal position for effecting return thereof to its rest position. Thus, the general overall mode of operation of mechanism 10 involves sensing the arrival of a weight in its unwound position, moving chain pulling means 16 downwardly for purposes of lifting such weight into its wound position and then returning the chain pulling means to its initial position to await return of such weight or another weight of the clock mechanism to its unwound position, whereupon a further cycle of operation is initiated.

More specifically, reference is now made to FIGS. 1 and 5–8, wherein chain pulling means 16 is shown as including a traveler member 20' and a plurality of pulling members 22*a*, 22*b* and 22*c*, which are arranged to operably engage one with each of chain free ends 14*a*", 14*b*" and 14*c*", respectively. Traveler member 20' and pulling members 22*a*, 22*b* and 22*c* are separately or individually mounted for vertically directed sliding movements by a guide track mechanism 24 consisting of a pair of parallel guide rails 26*a*, 26*b* and a pair of parallel guide tubes 28*a*, 28*b* interconnected adjacent their upper ends by a cross member 30. An upper pin shaft, not shown, intermediate pin shaft 32 and lower pin shaft 34 assist in maintaining guide rails 26*a*, 26*b* in parallel relationship and the lower ends of guide tubes 28*a*, 28*b* are fixed thereto by mounting blocks 36*a*, 36*b*. Cross member 30 is provided with a generally planar upper surface 38 through which extend a first bore opening 40*a* arranged in alignment with the interior of guide tube 28*a* and a second bore opening 40*b* which is slightly offset from alignment with guide tube 28*b*; a pair of upstanding hinge devices 42*a* and 42*b*; and preferably three forwardly facing spring detent devices 44*a*, 44*b* and 44*c* arranged for cooperation one with each of pulling members 22*a*, 22*b* and 22*c* for purposes of normally retaining same in their normal rest position shown in FIGS. 1 and 6.

Figure 4:
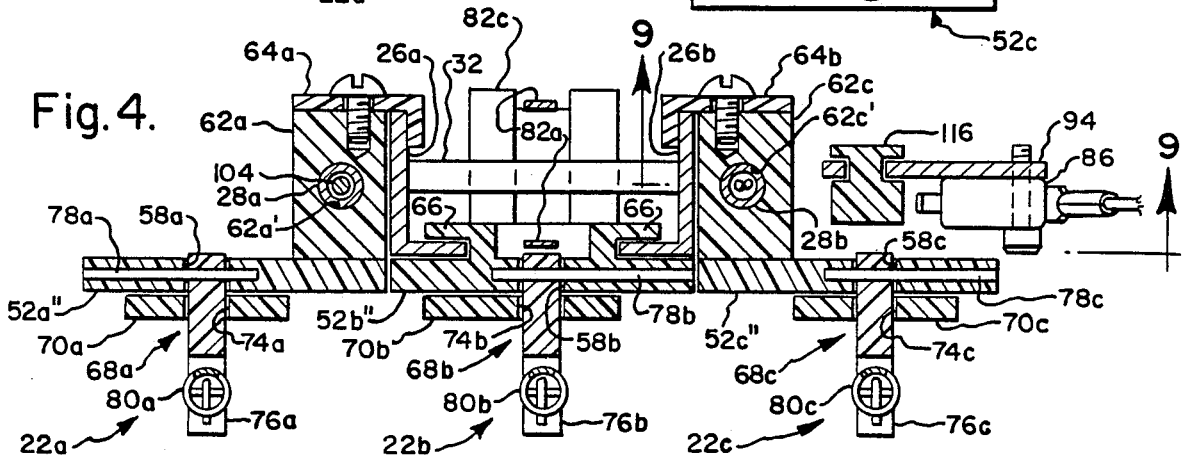
FIG. 4 is a sectional view taken generally along the line 4—4 in FIG. 1.

Traveler member 20' is shown in FIGS. 1 and 5–8 as being in the form of a generally rectangular plate formed with three rectangular slot openings 20*a*, 20*b* and 20*c*. Traveler member 20' is slidably supported on guide rails 26*a* and 26*b* by a slide plate shown in part at 46 only in FIG. 4, for vertically reciprocating movement between the upper rest position shown in FIGS. 1, 6 and 7 and a lower reversal position shown in FIG. 5. Traveler member 20' also carries a plunger mechanism 48 shown in FIGS. 6–10 as including a barrel 48*a*, a plunger 48*b*, a plunger supporting/adjustment screw 48*c* and a coil spring 48*d*; and a depending cam device 50 having a downwardly facing, vertically inclined cam surface 50*a*.

Pulling members 22*a*, 22*b* and 22*c* are shown in FIGS. 1 and 3–8 as including inverted, generally L-shaped carrier brackets 52*a*, 52*b* and 52*c* having horizontally disposed flanges 52*a*', 52*b*' and 52*c*' provided with access openings or recesses 54*a*, 54*b* and 54*c* disposed for proximate vertical alignment with weights 12*a*, 12*b* and 12*c* and guide openings 56*a*, 56*b* and 56*c* sized to freely receive chains 14*a*, 14*b* and 14*c* without permitting passage of chain free ends 14*a*", 14*b*" and 14*c*" upwardly therethrough; and vertically disposed flanges 52*a*", 52*b*" and 52*c*" formed with downwardly opening mounting slots 58*a*, 58*b* and 58*c*. Carrier brackets 52*a* and 52*c* are fixed by means of fasteners 60*a* and 60*c* to slide blocks 62*a* and 62*c*, which have vertically extending bore openings 62*a*' and 62*c*' sized to slidably receive guide tubes 28*a* and 28*b*, respectively, and which mount slide plates 64*a* and 64*c* best shown in FIG. 4 as being arranged to slidably engage with the rear edges of guide rails 26*a* and 26*b*, respectively. Carrier bracket 52*b* is suitably slidably supported by guide rails 26*a* and 26*b*, such as by providing its vertically disposed flange 52*b*" with integrally formed, generally L-shaped mounting slides 66 shown only in FIG. 4.

Figure 6:
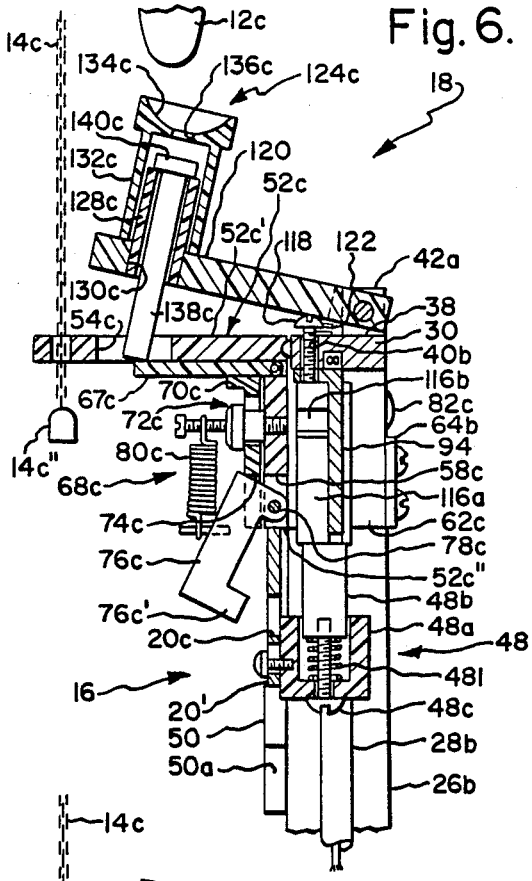
FIG. 6 is a sectional view taken generally along the line 6—6 in FIG. 2.
Figure 7:
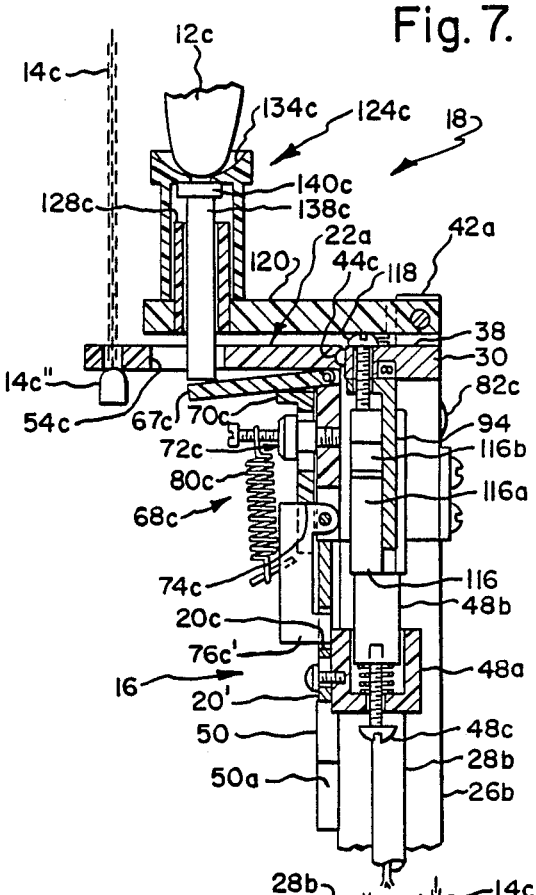
FIGS. 7 and 8 are views similar to FIG. 6, but showing subsequent steps in the operation of the mechanism.
Figure 8:
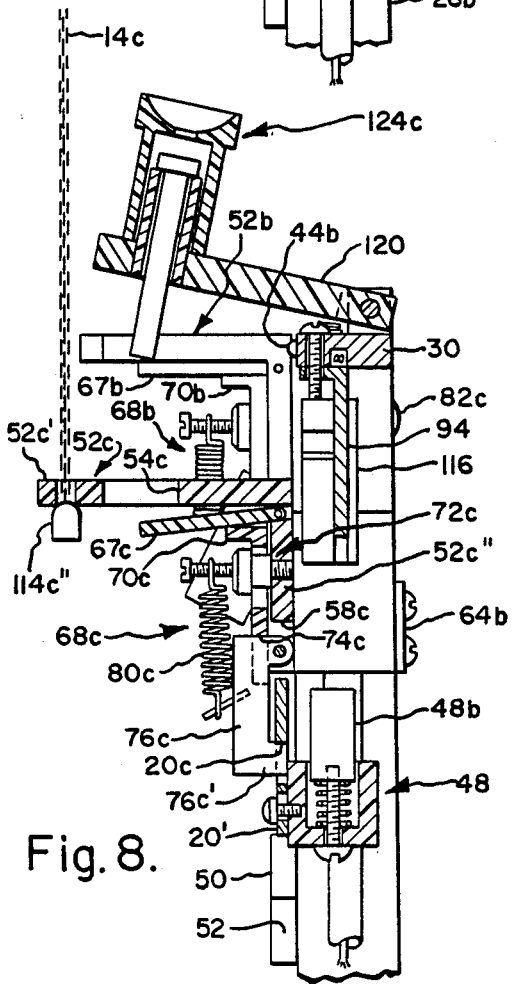

By referring to FIGS. 3 and 6–8, it will be understood that operating levers 67*a*, 67*b* and 67*c* are arranged to underlie carrier bracket flanges 52*a*', 52*b*' and 52*c*' with their rearwardly disposed ends pivotally supported on carrier bracket flanges 52*a*", 52*b*" and 52*c*" by suitable pivot pins only one of which is shown in FIGS. 6–8 at 67*c*' and their forwardly disposed ends normally arranged in vertical alignment with access openings or recesses 54*a*, 54*b* and 54*c*.

Pulling members 22*a*, 22*b* and 22*c* are provided with latch devices 68*a*, 68*b* and 68*c* serving to releasably and individually couple the pulling members to traveler member 20' for movement therewith between the rest position thereof shown in FIG. 1 and the reversal position thereof shown in the case of pulling member 22*c* in FIG. 5. In that these latch devices are of identical construction, only latch device 68*c* best shown in FIGS. 4 and 6–8 will be described and like parts of latch devices 68*a* and 68*b* will be designated by like numerals bearing suffixes "a" or "b". Latch device 68*c* comprises an inverted, generally L-shaped slide plate 70*c*, which is mounted on carrier bracket flange 52*c*" beneath operating lever 67*c* for vertically reciprocating movement by a guide pin/slot device 72*c* and is formed with a downwardly opening cam slot 74*c*; a generally L-shaped hook or latch member 76*c*, which has its upper end disposed within cam slot 74*c* and pivotally supported on the carrier bracket flange by pivot pin 78*c* and its lower or hooked end 76*c*' arranged for removable receipt within traveler member slot opening 20*c*; and a tension or return spring device 80*c*, which has its opposite ends connected to pin/slot device 72*c* and hook 76*c*, as shown in FIGS. 6–8 and tends to bias the hook, as well as operating lever 67*c*, into an inoperative or rest position best shown in FIG. 6.

By making reference to FIG. 1, it will be understood that chain pulling means 16 additionally includes a reversible drive motor 82 and driven means in the form of a drive belt 82*a* trained over motor driven pulley 82*b* and three guide rail mounted idler pulleys 82*c*; the driven means serving to couple the motor to traveler 20' in order to effect vertical movement of the latter between its rest and reversal positions shown in FIGS. 1 and 5, respectively. Operation of motor 82 is controlled by a control circuit including a first control switch 84*a*, which when closed serves to energize the motor to effect lowering of traveler member 20', and a second control switch 84*b*, which when energized serves to energize the motor to effect lifting of the traveler member; an "ON/OFF" power control switch 86; and a manually operated circuit control switch 88. A guide track mounted bracket 90 serves to support motor 82, switches 84a and 84b, and a circuit wiring junction box 92 with which switch 88 is associated; and a bracket 94 depending from cross member 30 serves to support switch 86.

The operating plungers 84a' and 84b' of switches 84a and 84b are arranged for engagement by legs 96a and 96b, respectively, of a switch control member 96, which is slidably supported on bracket 90 by guide pin/slot devices 98 for vertically directed reciprocating movements between upper and lower positions shown in FIGS. 11 and 12 for purposes of alternatively closing switches 84b and 84a, respectively. Switch control member 96 is biased by a compression spring 100 disposed intermediate bracket 90 and a right angularly related upper end flange 102 of the switch control member to normally assume its upper position, but can be forced to assume its lower position upon downwardly directed movement of a control rod 104, which is slidably supported for reciprocating movement within guide tube 28a and has its lower end arranged in engagement with a flange mounted abutment 102'. The upper end of control rod 104 is arranged to extend through cross member opening 40a and project above cross member surface 38 under the bias of spring 100.

By referring to FIGS. 11 and 12, it will be apparent that switch control member 96 may be temporarily retained in its lower position by the presence of sensing means 20, which in the presently preferred construction is defined by a latch arm 106 pivotally supported by a pivot pin 108 and biased by a spring 110 for pivotal movement in a counterclockwise direction, as viewed in FIG. 11, for engagement with flange 102 of the switch control member. The upper end of latch arm 106 is provided with an upwardly facing cam surface 112 arranged for engagement with a cam member surface 50a and a downwardly facing and offset latch surface 114 arranged to removably overlie an upwardly facing latch surface 102a defined by flange 102.

By referring to FIGS. 9 and 10, it will be seen that ON/OFF switch 86 is provided with a pivotally supported operator arm 86a arranged to cooperate with a switch operator 116, which is slidably supported for vertical reciprocating movement by bracket 94 and carries an adjustment screw 118 arranged to freely extend upwardly through cross member opening 40b with its upper end arranged to overlie cross member surface 38. One edge of switch operator 116 is shaped to define a generally planar surface 116a arranged to engage operator arm 86a for purposes of forcing switch 86 into its "OFF" condition and an adjacently disposed recess 116b arranged to receive the operator arm to permit such switch to assume its "ON" condition. It will be understood that spring biased plunger 48b is arranged to underengage switch operator 116 for the purpose of resiliently biasing same upwardly to normally assume its rest or switch "OFF" condition, whenever traveler member 20' is disposed in its upper or rest position, as best shown in FIG. 6.

Weight sensing means 18 is best shown in FIGS. 1, 2 and 6–8 as including a platform or plate 120, which is supported above cross member 30 by hinge devices 42a and 42b for vertical pivotal movement between the normal or rest and weight sensing positions shown in FIGS. 6 and 7, respectively; a suitable spring device 122 tending to normally bias the platform upwardly into its normal position. Platform 120 is fitted with three weight sensing plunger devices 124a, 124b and 124c arranged for cooperation with weights 12a, 12b and 12c, respectively, and bore openings 126a and 126b arranged to freely receive chains 14a and 14b respectively.

To facilitate description, only plunger device 124c will be described in detail with particular reference to FIGS. 2 and 6–8, and like parts of plunger devices 124a and 124b will be designated by like numerals bearing the suffixes "a" and "b". Plunger device 124c is shown in FIGS. 6–7 as including a guide sleeve 128c, which is non-movably fixed within a bore opening 130c provided in platform 120; an inverted cup-shaped weight engaging member 132c, which is slidably supported exteriorly of the guide sleeve and has its upper end formed with a weight receiving concave recess or pocket 134c disposed about a through bore opening 136c; and a drive plunger 138c, which is slidably supported interiorly of the guide sleeve and has an enlarged upper end 140c. It will be understood that recesses 134a, 134b and 134c are disposed in vertical alignment with weights 12a, 12b and 12c, respectively.

In the rest condition of mechanism 10 shown in FIG. 1, weight engaging member 132c rests on the upper surface of platform 120; and upper end 140c of drive plunger 138c rests against the upper end of guide sleeve 128c and the lower end of the drive plunger rests against or is in close proximity to the upper surface of operating lever 67c. Also in the rest condition of mechanism 10, the upper ends of control rod 104 and adjustment screw 118 engage with or in close proximity to the lower surface of platform 120.

Mechanism 10 is placed in operation by first mounting same beneath a clock to be rewound with plunger device recesses 134a, 134b and 134c disposed in vertical alignment with weights 12a, 12b and 12c and with the mechanism vertically positioned such that chain free ends 14a'', 14b'' and 14c'' are disposed closely adjacent the lower surfaces of bracket flanges 52a', 52b' and 52c', when the weights have descended sufficiently to force platform 120 to assume its downward pivotal position shown in FIG. 7. During set up of mechanism 10, the free ends of the chains would be temporarily removed in order to permit threading of the chains downwardly through openings 126a and 126b and through openings 56a, 56b and 56c.

To facilitate description of the mode of operation of mechanism 10, it will be assumed that the weights are disposed at some position thereof, such as those shown in FIG. 1, which are intermediate their fully wound and unwound positions, such that chain free ends 14a'', 14b'' and 14c'' are spaced below bracket flanges 52a', 52b' and 52c'. In this condition, mechanism 10 is in a rest or inoperative condition, wherein traveler member 20', pulling members 22a, 22b and 22c and platform 120 are disposed in their rest positions, as shown in FIGS. 1 and 6; power control switch 86 is in its "OFF" condition as shown in FIG. 9; switches 84a and 84b are in open and closed condition, respectively, as shown in FIGS. 1 and 11; and switch 88 is closed to supply current to the control circuit of the mechanism.

We next will assume that weight 12c is initially positioned and descending at a speed relative to weights 12a and 12b, such that it engages plunger device 124c, while weights 12a and 12b are still spaced some distance from their associated plunger devices 124a and 124b. Thereafter, weight 12c will eventually engage with member 132c within recess 134c and initiate downwardly directed pivotal movement of platform 120 against the bias of spring 122, as chain end 14c'' moves upwardly into close proximity with the lower surface of bracket flange 52c'. As platform 120 pivots downwardly, each of drive plungers 138a, 138b and 138c is free to slide upwardly within its associate guide tube until their upper ends underengage with the closed ends of their associated weight engaging members 132a, 132b and 132c. When this occurs in the case of drive plungers 138a and 138b, further continued pivotal movement of platform 120 into its final position shown in FIG. 7, will simply cause the weight engaging members to be temporarily lifted from engagement with the platform in that the weight of such weight engaging members is insufficient to effect downward pivotal movement of operating levers 67a and 67b against the bias of springs 80a and 80b. However, the presence of weight 12c within recess 134c prevents weight engaging member 132c from being lifted from engagement with platform 120 and as a result continued pivotal movement of the platform will cause drive plunger 138c to effect pivotal movement of operating lever 67c, which in turn drives slide plate 70c downwardly. Downward movement of slide plate 70c serves in turn to cam hook 76c downwardly against the return bias of spring 80c until its hooked end 76i c' is positioned within slot opening 20c of traveler member 20', as shown in FIG. 7.

As an incident to downward pivotal movement of platform 120, the upper end of control rod 104 is engaged and the control rod, together with switch control member 96, is forced to move downwardly against the return bias of spring 100 until such time as the switch control member is displaced sufficiently to close switch 84a and open switch 84b. When this occurs, flange latch surface 102a is disposed relatively below arm latch surface 114 and spring 110 operates to pivot latch arm 106 sufficiently to place arm latch surface 114 in an overlying, aligned relationship with the flange latch surface, as shown in FIG. 12. Upon release of pressure on control rod 104 by platform 120, when the latter is freed for movement towards its rest position in the manner to be described, spring 100 tends to bias switch control member 96 and thus the control rod upwardly towards their original rest positions, but is temporarily prevented from doing so by the latching action of latch arm 106.

Also, as an incident to downward pivotal movement of platform 120, the upper end of screw 118 is engaged and forced to move downwardly against the bias of bias spring 48d of plunger 48b until switch operator 116 is displaced sufficiently to position recess 116b in alignment with switch arm 86a, so as to permit switch 86 to assume its "ON" condition. When this occurs, motor 82 is immediately energized and traveler member 20' is caused to leave its rest position and descend towards its reversal position. Screw 118 is adjusted to insure that motor 82 is not energized before latch arm 76c has been placed in its latched position shown in FIG. 7 and switch control member 96 has been displaced sufficiently to permit latching thereof by latch arm 106 and the closing and opening of switches 84a and 84b, respectively, as shown in FIG. 12.

Immediately upon initiation of movement of traveler member 20', the upper end of latch slot 20c moves into frictional engagement with hook end 76c' of hook 76c with the result that the hook is frictionally captured within the latch slot and pulling member 22c coupled for conjunctive movement with traveler member 20', as shown in FIG. 8. Essentially simultaneously therewith, lower surface of carrier bracket flange 52c' engages with chain free end 14c'' with the result that a downwardly directed pulling force is exerted on such free end to initiate lifting of weight 12c. As lifting of weight 12c proceeds, platform 120 is freed for pivotal movement towards its initial or rest position shown in FIG. 6 under the bias of spring 122, whereby to free control rod 104 and screw 118 for subsequent upwardly directed movements for return to their initial or rest positions.

Lifting of weight 12c continues until traveler member 20' and pulling member 22c arrive at their reversal positions shown in FIG. 5, whereupon cam operator surface 50a engages with cam surface 112 of latch arm 106 for purposes of effecting clockwise directed movement of the latch arm against the bias of spring 110 sufficiently to remove arm latch surface 114 from overlying engagement with flange latch surface 102a, which frees switch control member 96, and thus control rod 104, for return to their initial or rest positions under the bias of spring 100. The return of switch control member 96 to its initial position serves to effect opening and closing of switches 84a and 84b, respectively, thereby to effect reversal of motor 82 for purposes of returning traveler member 20' and pulling member 22c to their initial or rest positions. As traveler member 20' approaches its rest position, plunger 48b effects return movement of switch operator 116 and screw 118 to their initial or rest positions, whereupon switch arm 86a is forced to ride out of recess 116b to effect return of switch 86 to its initial "OFF" condition to thereby deenergize motor 82. Reversal of the direction of movement of traveler member 20' serves to remove cam operator 50 from engagement with latch arm cam surface 112, so as to allow spring 110 to again pivot latch arm 106 in a counterclockwise sense, as viewed in FIGS. 5, 11 and 12, until it is disposed in its initial position shown in FIG. 11. It will also be understood that upon reversal of the direction of movement of traveler member 20', both the downwardly directed pulling force exerted on chain free end 14c'' and the frictional force exerted by the upper edge of slot opening 20c on hook 76c on account of downward movement of the traveler member are released or removed. Removal of the pulling force serves to uncouple pulling member 22a and chain free end 14c'', so as to permit chain 14c to remain relatively stationary and simply slide within bore opening 56c, as the pulling member is returned to its initial rest position. Removal of the frictional force allows spring 80c to immediately return hook 76c to its initial or rest position, thereby to uncouple or unlatch pulling member 22a from traveler member 20', such that the traveler member thereafter simply pushes the pulling member ahead of it as the traveler member returns to its initial or rest position. As an incident to the retraction of hook 76c from slot 20c, slide plate 70c is forced by the hook to return to its initial position, whereby it in turn serves to pivot operating lever 67c upwardly into its initial position shown in FIG. 6.

Upon return of the components of mechanism 10 to their initial positions shown in FIG. 1, a normal operational cycle of mechanism 10 is completed, and the mechanism is in condition to await the next cycle of operation to be initiated by the lowering of weights 12a or 12b into engagement with weight sensing means 18.

What is claimed is:

1. A mechanism for automatic winding of a clock driven by at least one weight supported by a chain for movement vertically between an upper clock wound position and a lower clock unwound position, wherein said chain has a first end attached to said weight and an opposite free end movable in a direction opposite to said weight as said weight moves between said clock wound and unwound positions, said mechanism comprising:

chain pulling means movable along a vertically extending path of travel between an upper rest position and a lower reversal position, said pulling means having means engageable with said free end of said chain for pulling down on said free end during movement of said pulling means from said rest position towards said reversal position;

weight sensing means responsive to the lowering of said weight into said clock unwound position for initiating movement of said chain pulling means from said rest position into said reversal position, whereby said free end of said chain is pulled downwardly to effect lifting of said weight from said unwound position into said wound position coincident to placement of said pulling means in said reversal position; and means responsive to placement of said chain pulling means in said reversal position for effecting return of said pulling means to said rest position.

2. A mechanism according to claim 1 and adapted for automatic winding of a clock driven by at least two weights independently supported by separate chains, wherein said pulling means includes common traveler means driven for movement along said path of travel and at least two chain pulling members having means individually engageable with the free ends of said separate chains, and said weight sensing means is responsive to the lowering of each of said weights into said clock unwound position for individually coupling said chain pulling members to said traveler means for movement therewith between said rest and reversal positions.

3. A mechanism according to claim 1, wherein said pulling means includes traveler and chain pulling members independently supported by a guide track for movement between said rest and reversal positions, said chain pulling member defining said means engaging with said free end of said chain, latch means for releasably coupling said chain pulling member to said traveler member for movement therewith from said rest position towards said reversal position, and operation of said latch means is controlled by said weight sensing means.

4. A mechanism according to claim 3, wherein said weight sensing means includes a platform movable vertically between first and second positions, spring means for biasing said platform into said first position, a plunger mechanism movably supported by said platform and having a first end arranged to be engaged by said weight upon movement thereof into said unwound position and a second end releasably engageable with said latch means to effect coupling of said chain pulling member to said traveler member.

5. A mechanism according to claim 1 and adapted for automatically winding a clock driven by at least two weights independently supported by separate chains, wherein said pulling means includes a common traveler member driven for movement along said path of travel and at least two chain pulling members individually engageable one with each of the free ends of said separate chains, each of said chain pulling members having an individually operable latch means for releasably coupling said chain pulling members to said traveler member for movement therewith from said rest position towards said reversal position, and said weight sensing means includes at least two weight sensing mechanisms disposed in vertical alignment one with each of said weights and one with each of said chain pulling members, and said weight sensing mechanisms are responsive to the lowering of the weight with which they are aligned for operating said latch means of the chain pulling member with which they are aligned.

6. A mechanism according to claim 5, wherein said weight sensing means additionally includes a platform supported for vertical movement between first and second positions and spring means for normally biasing said platform into said first position, said platform carrying said weight sensing mechanisms and being movable thereby to assume said second position upon engagement of said weights with said weight sensing mechanisms with which they are aligned; said chain pulling means additionally includes a reversible motor drivingly coupled to said traveler member, an ON/-OFF switch for energizing said motor, alternatively operable switch means for reversing the direction in which said motor is driven to effect movement of said traveler member in a first direction extending from said rest position towards said reversal position and in a second direction extending from said reversal position towards said rest position, means operable in response to movement of said platform into said second position for placing said ON/OFF switch in an ON condition and responsive to return of said traveler member to said rest position for placing said ON/OFF switch in an OFF condition, switch operating means supported for movement between first and second positions thereof and including spring means tending to maintain said switch operating means in said first position thereof to place said alternatively operable switch means in a first condition for causing said motor when energized to drive said traveler member in said second direction and opposing movement of switch operating means into said second position thereof to place said alternatively operable switch means in a second condition for causing said motor when energized to drive said traveler member in said first direction, said platform upon movement between said first and second positions thereof effecting movement of said switch operating means between said first and second positions thereof; and said means responsive to placement of said chain pulling means in said reverse position includes a latch device arranged to releasably engage with said switch operating means for releasably retaining said switch operating means in said second position thereof and cam means carried by said traveler member and arranged to engage with said latch device upon placement of said traveler member in said reversal position to effect release of said latch device from said switch operating means to permit said spring thereof to move said switch operating means into said first position thereof.

7. A mechanism for automatic winding of a clock driven by at least one weight supported by a chain for movement vertically between an upper clock wound position and a lower clock unwound position, wherein said chain has a first end attached to said weight and an opposite free end movable in a direction opposite to said weight as said weight moves between said clock wound and unwound positions, said mechanism comprising:

a vertically extending guide means;

a traveler member supported by said guide means for movement therealong between upper rest and lower reversal positions;

reversible drive means;

driven means for coupling said drive means to said traveler member to effect movement thereof along said guide means between said rest and reversal positions;

first switch means for operating said drive means when energized to effect movement of said traveler member from said rest position towards said reversal position;

second switch means for operating said drive means when energized to effect movement of said traveler member from said reversal position towards said rest position;

power control switch means having ON and OFF conditions for energizing and deenergizing said drive means, respectively;

a chain pulling member provided one in association with each said weight and mounted by said guide means for movement between rest and reversal positions thereof corresponding to said rest and reversal positions of said traveler member, each said pulling member having means arranged for engagement with said free end of said chain of its associated weight for pulling down on said free end during movement of said pulling member from said rest position thereof towards said reversal position thereof to effect lifting of its associated weight from said unwound position into said wound position, each said pulling member additionally having latch means for removably coupling said pulling member for movement with said traveler member from said rest position thereof into said reversal position thereof;

weight sensing means operating in response to the lowering of said weight into said unwound position thereof for operating said latch means of said pulling member associated therewith to couple same to said traveler member, for operating said first switch and for placing said power control switch in said ON condition whereby to energize said drive means and effect movement of said traveler member from said rest position thereof towards said reversal position thereof;

means responsive to the presence of said traveler member in said reversal position thereof operating said second switch means to effect movement of said traveler member and said pulling member releasably coupled thereto from said reversal positions thereof towards said rest positions thereof; and means operable in response to return of said traveler member to said rest position thereof for returning said power control switch to said OFF condition.

8. A mechanism according to claim 7, wherein said latch means upon operation thereof by said weight sensing means is maintained in an operated condition for coupling said pulling member to said traveler member during movement from said rest positions thereof into said reversal positions thereof by a pulling force exerted on said free end of said chain by said pulling member, said pulling force being released incident to initiation of return movement of said traveler member from said reversal position, said traveler member being arranged to push said pulling member from said reversal position thereof into said rest position thereof.

9. A mechanism according to claim 8, wherein said weight sensing means includes a platform pivotally supported for vertical movement between upper first and lower second positions, a platform spring for biasing said platform to normally assume said upper first position and a plunger mechanism provided one in association with each of said weights and disposed in vertical alignment therewith said said chain pulling member with which said weight is associated, said plunger mechanism having an upper end arranged for engagement by said weight upon movement thereof into said unwound position for effecting pivotal movement of said platform against said bias into said second position thereof under the influence of gravity acting on said weight, said plunger mechanism having a lower end arranged for engagement with said pulling member to effect operation of said latch means incident to movement of said platform into said second position thereof, said platform spring biasing said platform for return to said first position thereof as said weight is lifted for return to its wound position by said pulling member pulling down on said free end of said chain associated with said weight, said first and second switch means are alternatively opened and closed by control means including a switch control member supported for vertical reciprocating movement and normally biased to assume an upper position wherein said first and second switch means are opened and closed, respectively, for operating said drive means when energized to effect movement of said traveler member from said reversal position towards said rest position, said platform engaging with said control means during movement thereof into said lower second position to move said switch control member into a lower position wherein said first and second switch means are in closed and open conditions, respectively, for operating said drive means when energized to effect movement of said traveler member from said rest position towards said reversal position, and said means responsive to the presence of said traveler member in said reverse position includes a cam carried by said traveler member and a pivotally supported latch arm biased to latch said switch control member in said lower position thereof, and said cam is arranged to engage said latch arm upon movement of said traveler member into said reversal position to effect unlatching of said switch control member for return to said upper position thereof.

* * * * *